United States Patent [19]

Monks

[11] Patent Number: 4,530,230

[45] Date of Patent: Jul. 23, 1985

[54] FOIL ROLLING METHOD AND APPARATUS

[75] Inventor: Frank E. Monks, Bettendorf, Iowa

[73] Assignee: Aluminum Company of America, Pittsburgh, Pa.

[21] Appl. No.: 551,183

[22] Filed: Nov. 14, 1983

[51] Int. Cl.[3] ..... B21D 31/00

[52] U.S. Cl. ..... 72/363; 72/234; 29/18

[58] Field of Search ..... 72/234, 363; 29/17 R, 29/18

[56] References Cited

U.S. PATENT DOCUMENTS

| | | | |
|---|---|---|---|
| 11,241 | 5/1892 | Sichel | 100/264 |
| 1,225,044 | 5/1917 | Lauber et al. | 72/39 |
| 1,910,684 | 5/1933 | Stringham | 424/158 |
| 1,959,087 | 5/1934 | Tainton et al. | 29/18 |
| 2,075,273 | 2/1936 | Dahl | 72/38 |
| 2,529,884 | 6/1946 | Reynolds | 29/18 |
| 3,049,229 | 6/1958 | Nagle et al. | 29/18 |
| 3,169,300 | 6/1958 | Nagle et al. | 29/18 |
| 3,613,319 | 3/1970 | Takimura et al. | 51/249 |
| 4,092,202 | 5/1978 | Bergk et al. | 156/331.7 |
| 4,155,154 | 5/1979 | Markarian et al. | 29/570 |
| 4,220,484 | 9/1980 | Prohaska et al. | 148/6.3 |
| 4,240,128 | 12/1980 | Van Alphen et al. | 361/433 |
| 4,245,276 | 1/1981 | Herwijnen et al. | 361/433 |
| 4,255,049 | 3/1981 | Sahm et al. | 356/32 |
| 4,348,712 | 9/1982 | Newcomb | 364/200 |

*Primary Examiner*—Lowell A. Larson
*Assistant Examiner*—Jorji M. Griffin
*Attorney, Agent, or Firm*—David W. Brownlee

[57] ABSTRACT

A method and apparatus for rolling of bright foil wherein a foil pack is comprised of foil webs each having a relatively bright side and a relatively gray side, which webs are provided by a split mill having work rolls which are differentiated as to surface finish roughness, and wherein the pack is formed with the relatively bright sides of the foil webs juxtaposed and the relatively gray sides thereof providing contact surfaces which contact the pack mill work rolls during pack rolling.

9 Claims, 1 Drawing Figure

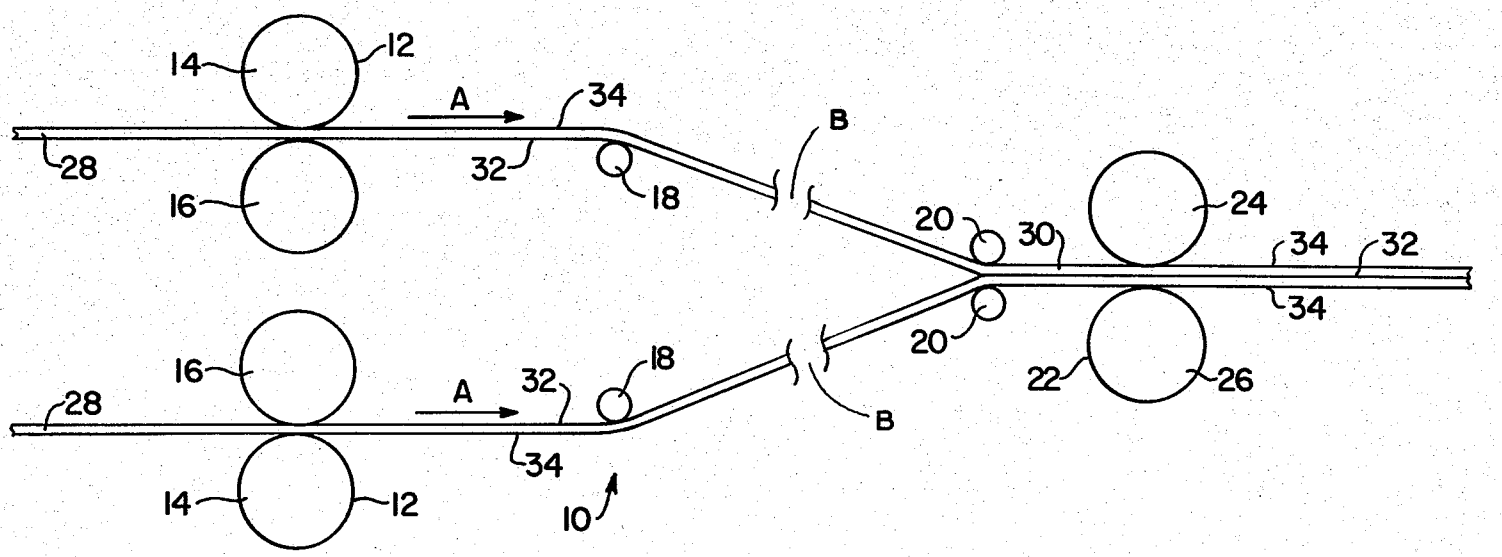
32
34
34
24
26
30
22
20
20
B
B
18
18
34
32
32
34
10
A
A
12
12
14
16
16
14
28
28

FOIL ROLLING METHOD AND APPARATUS

BACKGROUND OF THE INVENTION

This invention concerns processes for the manufacture of metal foil such as aluminum foil that is widely accepted for household use as a decorative and/or utilitarian wrapping material.

Known foil products are available in a selection of thin metal gauges ranging from 0.0059 inch gauge to about 0.00025 inch gauge, for example. These foils are commonly produced by rolling processes in which the aluminum web or strand is passed through a series of rolling mills to progressively reduce the metal gauge to achieve the desired final product thickness.

In the final two rolling operations of the usual thin foil rolling process, the penultimate pass is called the split pass wherein a single web of aluminum typically of about 0.0014 inch thickness is rolled to a thickness of about 0.0006 inch. A single web of this thickness is too thin to be rolled in the final rolling operation without incurring foil strand breakage and other problems. Therefore, two such foil webs are rolled together through the final pass in a process called pack rolling to achieve a final total thickness of about 0.0005 inch for the pack or about 0.00025 inch per web. The two webs are subsequently separated, trimmed to width and wound to individual coils.

The known foil rolling processes, and in particular the split pass and pack rolling steps, must be closely controlled to achieve the most efficient and economical production rates, to minimize waste and to ensure acceptable final product quality. These objectives are not easily achieved because they tend to impose contrary requirements on the rolling process. For example, one way to increase production rates is to use so-called gray or relatively rough work rolls in the rolling mills as it is generally known that gray rolls run faster. However, it is also known that the rolled product tends to assume the surface finish of the work roll finish. Thus, gray rolls produce a gray finish on the foil which would be unacceptable in the final product as the market generally demands a bright foil finish. Therefore, gray rolls typically are utilized only prior to pack rolling and polished rolls are utilized in the pack rolling step to provide a bright surfaced foil product. The outer foil surfaces of the pack contact the polished pack rolls and thus assume a bright finish whereas the mated surfaces of the two webs of the pack assume a matte finish during pack rolling. Here too there exists the potential for contrary demands on the production process, for it is well known that incoming gray metal makes the mill run faster. Thus, if gray metal surfaces of the pack contact the pack mill work rolls, the production rate of foil through the pack mill may be enhanced. However, the use of gray rolls in the split mill to produce gray metal for pack rolling also may result in an undesirable gray undertone becoming prominent in the surface finish of the pack rolled foil. Also, any grayness in the rolls utilized in the pack mill to enhance rolling speed will tend to diminish the specularity of the final foil product. Both undertone and specularity are parameters of foil surface brightness. As the market usually demands bright foil, it is desirable to maximize specularity and minimize undertone; however, as noted above, the means of accomplishing these ends tend to adversely impact foil production rates. Still further, it is accepted practice to grind both work rolls of the split mill to a uniform and identical finish to ensure equal grayness on the opposite sides of the foil coming from the split mill. There are known instances wherein foil having differentiated surface grayness was subject to breakage and developed very poor quality surface finish during subsequent pack rolling operations.

For these and other reasons, the prior art has been fraught with numerous limitations which have frustrated the simultaneous maximizing of foil product quality and production economy.

BRIEF SUMMARY OF THE INVENTION

The above and other limitations of the prior art are alleviated by the present invention which provides improved methods and apparatus for achieving significant increases in thin gauge foil production rates and therefore in production economy without sacrificing product quality, notably surface brightness, in the finished product. The invention concerns methods and apparatus for rolling foil in the split mill with a pair of work rolls having differentiated surface finish in that one roll is relatively brighter and the other is relatively grayer. An aluminum web rolled in such a split mill has a relatively brighter and a relatively grayer side, and the relatively brighter sides of two such split milled webs are subsequently mated for pack rolling with the gray sides of the strips in contact with the polished pack mill rolls. The result is a significant gain in foil production rates from the pack mill and/or superior end product surface finish and brightness.

Another advantage of the invention is that the occasional appearance of bright specks in the matte surface of the foil product, often referred to as broken matte and known to occur in conventional rolling processes, has not been encountered in foils processed according to the instant invention. Broken matte is an undesirable condition, the elimination of which is an important contribution to product quality and production economy.

It is therefore one primary object of the invention to provide an improved and novel method and apparatus for rolling of thin gauge foil.

Another object of the invention is to provide a foil rolling apparatus which produces, at an intermediate rolling step, foil of differentiated surface brightness or grayness and enhanced subsequent pack rolling of the foil.

A more specific object of the invention is to provide a foil rolling method and apparatus wherein foil is rolled in a split mill having differentiated roll surface finishes to produce a foil web having correspondingly differentiated surface finishes and wherein the relatively brighter sides of two such foil webs are mated for subsequent pack rolling thereof.

These and other objects and advantages of the invention will be more clearly understood upon consideration of the following description and the sole accompanying FIGURE, in which there is shown in schematic form a fragmentary portion of a foil rolling sequence including apparatus of the present invention and by which the method of the present invention may be carried out.

DESCRIPTION OF THE PREFERRED EMBODIMENT

There is generally indicated at 10 in the FIGURE a fragmentary portion of a foil rolling sequence including a pair of split mills 12, each having work rolls 14 and 16. Guide rolls 18 and 20 of any suitable nature are provided to guide the aluminum webs 28 to and from the split mills 12 and a pack mill 22. Ordinarily, several aluminum webs 28 will be split rolled in a single split mill and individually coiled. Pairs of the split rolled webs are subsequently formed as a pack and rolled in the pack mill. In the schematic FIGURE two split mills are shown feeding split rolled webs to a pack mill. The break B in the FIGURE is to clarify that in practice the split rolling and pack rolling operations are not actually carried out as a continuous sequence.

A web of aluminum 28, shown with exaggerated thickness in the FIGURE to distinguish the opposite surfaces thereof, is passed through each split mill 12 between respective pairs of work rolls 14 and 16 in the direction indicated by arrows A, and subsequently two webs 28 are guided as by guide rolls 18 and 20 from split mills 12 to pack mill 22. Apparatus, not shown, may be utilized to collect the aluminum webs from split mills 12 (e.g., by coiling the webs) for later formation of a pack 30 to be pack rolled in mill 22. The pack 30 is rolled in the pack mill 22 between work rolls 24 and 26, and thence is directed to such subsequent operations as separating and coiling which are well known in the art.

As mentioned hereinabove, it is common practice to grind split mill work roll pairs to equal roughness of surface finish in order to produce foil output of equal grayness on its opposite sides. For example, split mill roll surface finishes of approximately 3.5$\mu$ (micro inches) have been commonly utilized, and there is evidence that split rolls equally finished to a surface finish of 4$\mu$ create acceptable but nevertheless undesirably high levels of undertone in the pack metal finish. For purposes of the present invention, however, the surface finish of the split mill rolls 14 and 16 is intentionally differentiated to provide one relatively rougher roll and one relatively smoother roll in each pair. For example, each roll 14 may be ground to a surface roughness or finish in the range of approximately 4 $\mu$ to approximately 10$\mu$, 5.7$\mu$ for example, and the respective rolls 16 may be ground to a surface finish of 1.6$\mu$. The webs 28 are processed through respective split mills 12 and thus acquire a relatively brighter surface 32 and a relatively gray surface 34. These two webs 28 are subsequently utilized to form pack 30 which is then pack rolled in pack mill 22. The rolls 24 and 26 of pack mill 22 are of equally polished surface finish, for example in the range of approximately 1.4 to 1.6$\mu$. In pack 30, the webs 28 are mated with the relatively bright surfaces 32 thereof together and the relatively rough or gray surfaces 34 thereof facing outward and contacting the respective pack mill work rolls 24 and 26 during pack rolling.

It has been found that the foil which is split rolled and pack rolled on apparatus such as that described above and according to the described method is of superior surface finish at pack rolling output speeds considerably in excess of those previously attainable in pack rolling of foil to similar surface finish quality specifications. For example, when foil webs were split rolled and pack rolled as described above with their relatively brighter surfaces mated, foil of unexpectedly high quality surface finish and brightness was produced at a pack mill speed of 1300 fpm (feet per minute). This result was contrary to prior art experience because, as noted above, it is generally accepted that increased mill speed achieved by the use of gray rolls, whether in the split mill or in the pack mill, results in grayer or less bright foil. By contrast, when the described differentiated webs 28 were reversed for pack rolling so that the gray sides 34 were mated together and the bright sides 32 were in contact with the pack mill rolls, a foil of expected and suitable surface finish was also produced, but the pack mill speed was only 685 fpm.

According to the description hereinabove, there is provided by the instant invention an improved apparatus and method for split rolling and pack rolling of thin gauge foils wherein superior foil surface finish is achieved at higher than customarily expected pack mill speeds by producing split rolled foil webs of differentiated surface finish and by mating such split rolled webs for pack rolling such that the relatively brighter sides of the webs are together and the relatively grayer sides thereof contact the pack mill work rolls.

A specific preferred embodiment of the invention having been described hereinabove, it is to be appreciated that the scope of the invention is not so limited and it is rather intended that the invention be construed as broadly as permitted by the scope of the claims appended hereto.

I claim:

1. In a foil rolling process for producing thin gauge metal foil, the method of producing pack rolled foil comprising the steps of:

providing a pair of metal webs each having differentiated surface finishes on opposite sides thereof;

mating said metal webs for pack rolling thereof with the relatively brighter sides thereof together and the relatively grayer sides thereof oriented to contact the pack mill work rolls; and pack rolling the mated metal webs to produce a pair of pack rolled foil strips.

2. The method as claimed in claim 1 including the additional step of split rolling metal to provide said metal webs having said differentiated surface finishes on opposite sides thereof.

3. In a foil rolling process for producing thin gauge metal foil, the method of producing a pair of pack rolled foil webs comprising the steps of:

providing a pair of metal webs;

rolling each of said metal webs between a first pair of work rolls to produce on opposite sides of each of said webs a relatively brighter surface finish and a relatively grayer surface finish;

mating said pair of webs with the respective brighter surface finish sides thereof together to form a pack; and rolling said pack between a second pair of work rolls which contact the respective relatively grayer sides of said webs.

4. The method as claimed in claim 3 wherein said second pair of work rolls are the rolls of a pack mill which provide the final rolling operation in the foil rolling process.

5. The method as claimed in claim 4 wherein said first pair of work rolls are the rolls of a split mill.

6. The method as claimed in claim 5 wherein said first pair of work rolls have surface finishes which are differentiated to produce said relatively brighter and relatively grayer surface finishes.

7. The method as claimed in claim 6 wherein one roll of said first pair of work rolls has a surface finish in the range of approximately 4 $\mu$ to approximately 10 $\mu$, and the other roll of said first pair of work rolls has a surface finish of approximately 1.6 $\mu$.

8. The method as claimed in claim 7 wherein said one roll has a surface finish of approximately 5.7 $\mu$.

9. The method as claimed in claim 8 wherein each roll of said second pair of work rolls has a surface finish in the range of approximately 1.4 $\mu$ to approximately 1.6 $\mu$.

* * * * *